US007063203B2

(12) United States Patent
Gonzalez Alemany et al.

(10) Patent No.: US 7,063,203 B2
(45) Date of Patent: Jun. 20, 2006

(54) VARIABLE SPEED HANDRAIL FOR PASSENGER MOVING WALKWAY SYSTEMS

(75) Inventors: Miguel Angel Gonzalez Alemany, Asturias (ES); Juan Domingo Gonzalez Pantiga, Asturias (ES); Manuel Alonso Cuello, Asturias (ES)

(73) Assignee: Thyssenkrupp Norte, S.A. (ES)

( * ) Notice: Subject to any disclaimer, the term of this patent is extended or adjusted under 35 U.S.C. 154(b) by 0 days.

(21) Appl. No.: 11/091,171

(22) Filed: Mar. 28, 2005

(65) Prior Publication Data

US 2005/0217970 A1 Oct. 6, 2005

(30) Foreign Application Priority Data

Mar. 30, 2004 (ES) ..... 200400773

(51) Int. Cl.
*B66B 21/12* (2006.01)

(52) U.S. Cl. ..... 198/334; 198/335

(58) Field of Classification Search ..... 198/331, 198/334, 335
See application file for complete search history.

(56) References Cited

U.S. PATENT DOCUMENTS

| | | | | |
|---|---|---|---|---|
| 3,842,961 | A | 10/1974 | Burson | 198/16 |
| 3,899,067 | A * | 8/1975 | Kondo et al. | 198/335 |
| 4,232,776 | A | 11/1980 | Dean | 198/322 |
| 4,240,537 | A * | 12/1980 | Dunstan | 198/334 |
| 4,509,429 | A * | 4/1985 | de Broqueville | 198/334 |
| 6,138,816 | A | 10/2000 | Sato et al. | 198/334 |
| 6,602,331 | B1 | 8/2003 | Gonzalez Alemany et al. | 96/66 |

FOREIGN PATENT DOCUMENTS

| | | |
|---|---|---|
| FR | 2207069 | 6/1974 |
| FR | 2757143 | 6/1998 |
| FR | 2792626 | 10/2000 |
| GB | 2264686 | 9/1993 |

* cited by examiner

*Primary Examiner*—James R. Bidwell
(74) *Attorney, Agent, or Firm*—Ostrolenk, Faber, Gerb & Soffen, LLP

(57) ABSTRACT

A variable speed handrail for a passenger moving walkway system, comprising a flexible profile comprised of a plurality of fixed blocks each having a grooved structure and circulating along the walkway or escalator and moving with a constant speed. A plurality of handgrips coupled on the flexible profile which move at a substantially identical speed. The handgrips have for their dragging first and second connection devices respectively connected to a constant speed and a variable speed drag mechanism.

17 Claims, 5 Drawing Sheets

VARIABLE SPEED HANDRAIL FOR PASSENGER MOVING WALKWAY SYSTEMS

FIELD OF THE INVENTION

The present invention refers to a variable speed handrail for passenger moving walkway systems, especially applicable to variable speed moving walkways and escalators for transporting people or materials.

More specifically, the handrail of the invention is of the type comprising a flexible profile circulating along the walkway or escalator, with a forward moving section and a return section; a drag mechanism of the profile; and a plurality of handgrips coupled on the flexible profile.

STATE OF THE ART

Several variable speed handrail systems for walkways and escalators are already known.

For example, a system made up of several constant speed handrails is known in which each handrail circulates at a different speed form the previous one, or as close as possible to the speed of the treads in the same area. Handrails with this makeup are disclosed, for example, in French patent number 2,757,143 and in European patent number 0 837 026.

This type of systems has the following drawback: the handrail speed at given points differs considerably from the tread speed, causing an unpleasant and uncomfortable sensation for the user, and could even represent a safety problem.

Handrail systems made up of independent blocks or handrails, such as that disclosed in U.S. Pat. No. 4,232,776, are also known. In some cases, the handgrips are linked by means of intermediate extendible members. Said extendible members can be bellows, as in the case of British patent number 2,264,686 and U.S. Pat. Nos. 3,842,961, 6,138,816 and 6,602,331. The possibility of using a chain of a fixed length between each handgrip is also known as is disclosed in French patent numbers 2,792,626 and 2,207,069.

The system made up of independent handgrips without intermediate linking members poses a serious safety problem, given that it does not have a uniform and continuous user support surface. This fact could cause the user to attempt to grip an immobile surface with the subsequent danger of falling.

The bellows-type flexible members used in the other alternatives do not make up a reliable safety member, since they are susceptible of becoming strained under the pressure exerted by a user resting against it.

The systems including chains as intermediate members have a problem with vibrations, since the linking member is used as a power transmitter member, given that the moving direction is perpendicular to the stress transmittal direction.

Finally, a variable speed continuous handrail formed by a rubber belt with an internal cable mesh structure is known from European patent number 0 831 052.

This system is relatively complicated and furthermore does not allow a high speed ratio between the entry area and the central area.

The present invention has as an object providing a handrail for a variable speed moving walkway or escalator which is of a simple construction and allows completely covering the support surface such that it represents a safe and effective support for the user.

DESCRIPTION OF THE INVENTION

As has already been indicated, the handrail of the invention comprises a flexible profile running along the walkway or escalator, with a forward moving section and a return section, a drag mechanism for the profile, and a plurality of handgrips coupled on the flexible profile.

According to the invention, the flexible profile moves with a constant speed throughout its entire span, whereas the handgrips are independent of the profile and move with a speed substantially identical to the speed of the closest walkway plates. As these walkway plates move along the belt or escalator at a constant speed in certain sections and at a variable speed in other sections, the handgrips will move at a constant speed in the same sections as the walkway plates and at a variable speed in the same sections as said plates do.

To achieve this shifting of the handgrips at a variable or constant speed, the handgrips have first and second connection means connected to the flexible profile or with its drag mechanism and with a variable speed auxiliary drag mechanism. The first connection means connect the handgrip to the flexible profile or drag mechanism thereof when the handgrip shifts along the section in which the walkway plates move at a constant speed, whereas the second connection means connect the handgrip to the variable speed auxiliary drag mechanism when the handgrips shift along the sections in which the walkway plates move at a variable speed.

The first connection means may comprise an anchor tooth that can shift between an active position, in which it meshes with the flexible profile or with its drive mechanism, in order to cause the handgrip to be dragged by the flexible profile at the same speed as it is itself, and a withdrawn position in which the meshing is cancelled and in which the handgrip is no longer dragged by the flexible profile or its drive mechanism.

For their part, the second connection means comprise an arm projecting from one of the sides of the handgrips and meshing with a variable pitch worm running along the section in which the walkway plates move at a variable speed.

The flexible profile can be made up of a chain that shifts at a variable speed and on which discrete members having a grooved geometry are assembled, covering the chain and allowing the users to hold on in the serviceable area.

The flexible profile and handgrips will have complementary sections between which there is a certain clearance, such that the handgrips can slide on the flexible strip.

The handgrips and the first and second connection means of the handgrips are assembled in a carriage that can shift on a guide running immediately inside the flexible profile, close to the drag mechanism of the flexible profile. This guide ensures a slight gap or clearance between the flexible profile and the handgrips so as to facilitate the shifting of the handgrips on the flexible profile. The guide further has a cam responsible for shifting the anchor tooth between the active and withdrawn positions.

In the belt or escalator overturn area, the handgrips, by means of the aforementioned guide, mesh through the anchor tooth with the flexible profile or with its drive mechanism, circulating at a high but constant speed. When the handrail exits the overturn areas, the cam of the guide shifts the anchor tooth towards the withdrawn position, whereas the arm making up the second connection means meshes with the variable speed drive system.

The transition from one situation to the other is carried out as follows: initially, the handgrip is meshed with the constant speed drive system or with the flexible profile by means of the anchor tooth. This anchor system is released by the cam of the guide acting according to a profile with the appropriate geometry, which causes the meshing or de-meshing of the anchor tooth with the variable speed drive system in the precise moment.

Throughout the variable speed area, the handgrips circulate with the anchor tooth in its withdrawn position, whereas the side arm is meshed with the variable speed drive system. In this area, the handgrips slide over the flexible profile. First, a deceleration of the handgrips occurs until it reaches a minimum speed, which would be the entry speed onto the walkway or escalator. Subsequently, a smooth acceleration occurs until reaching maximum speed. Finally, in the high speed area the handgrips mesh with the constant speed drive system or with the flexible profile and therefore circulate at the same speed as the latter.

With the makeup set forth, the speed of the handgrips will be identical to the speed of the walkway or escalator passenger walkway system. In this manner there will be no transitions between handrails, therefore safety for the user is increased, and all with a simple system which allows covering the entire surface of the variable speed handrail.

The dragging of the flexible profile or belt at a constant speed and the drive of the variable speed auxiliary mechanism is carried out from the same drive mechanism.

The drag mechanism of the flexible profile may consist of a system of gears or chains, a friction system or electromagnetic attraction systems.

The flexible profile may also comprise an endless belt of a resilient material, made with one or several layers of different materials and which will allow users to hold on to it in the serviceable area. With this makeup, the flexible belt may have a toothed inner surface allowing its meshing with a constant speed drag mechanism. This flexible belt may also have an inner surface allowing its friction with a drag mechanism so as to achieve the same constant speed movement.

According to another embodiment variant, the flexible belt can internally have metal members allowing their dragging or movement at a constant speed by means of an electromagnetic induction system.

The features of the invention will be better understood with the description of an embodiment shown in the enclosed drawings.

DETAILED DESCRIPTION OF EMBODIMENTS OF THE INVENTION

Figure 1:
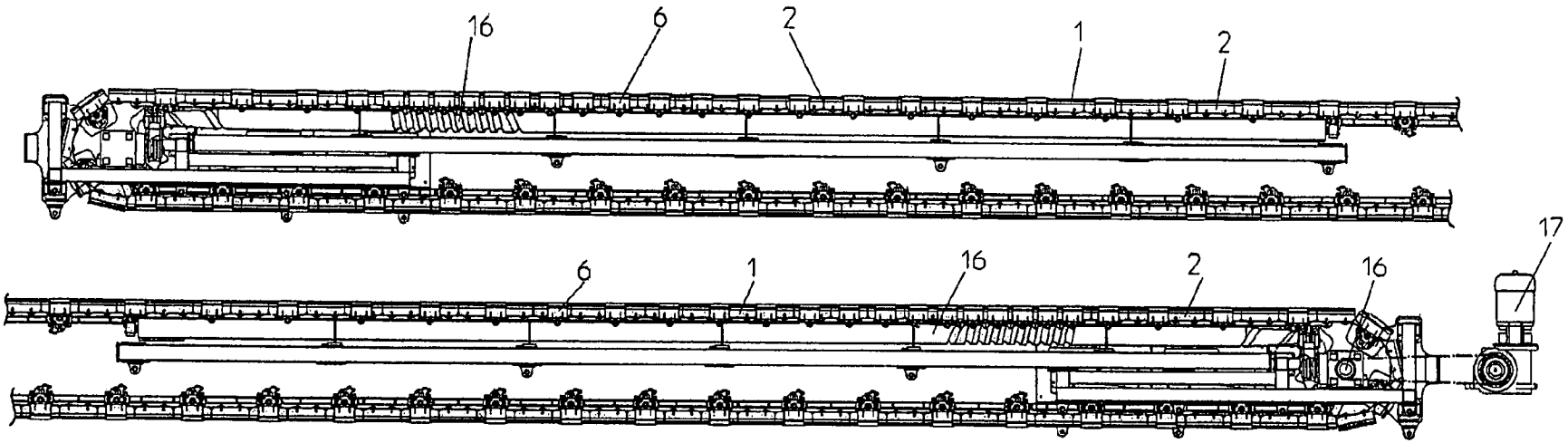
FIG. 1 shows a side elevational view of a scheme of the variable speed handrail of the invention.
Figure 2:
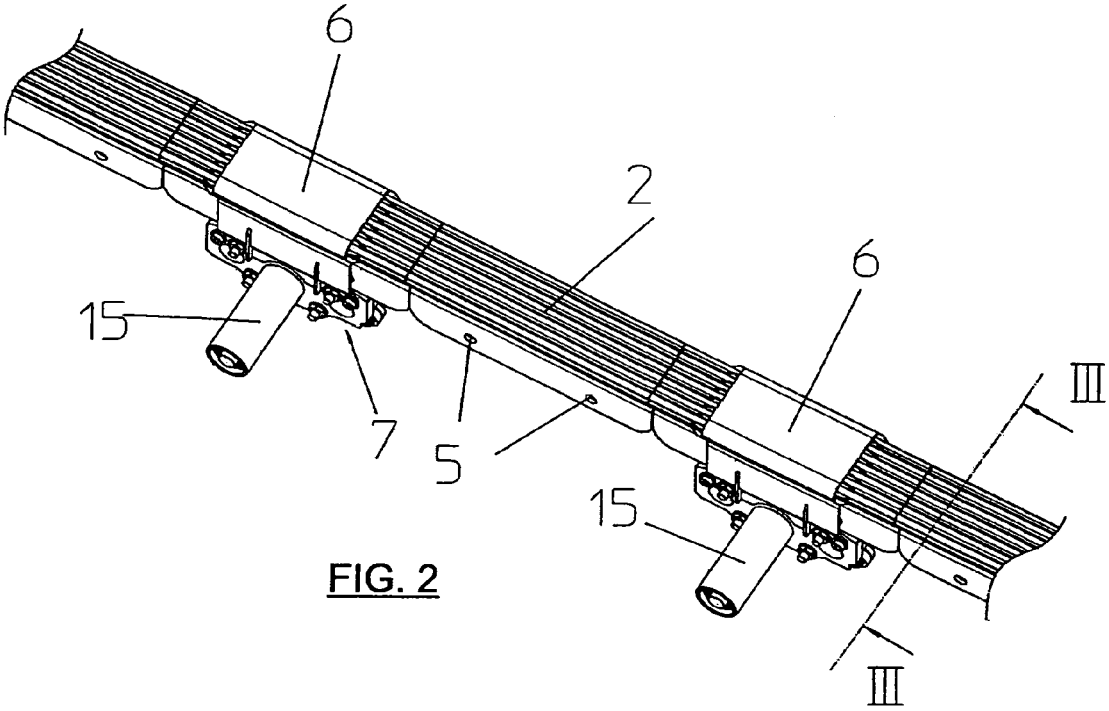
FIG. 2 shows a perspective view of a detail of the variable speed handrail of FIG. 1.

FIG. 1 shows a side elevational view of a variable speed handrail according to the invention. This handrail comprises a flexible profile 1 comprising a plurality of fixed blocks 2 of a grooved structure coupled on a chain 3 including freely rotating rollers 4. The sections 2 are fixed to the chain 3 by means of screws or pins 5.

Handgrips 6 are assembled on certain blocks 2 of the flexible profile 1, each one of which is assembled on a carriage 7.

Figure 3:
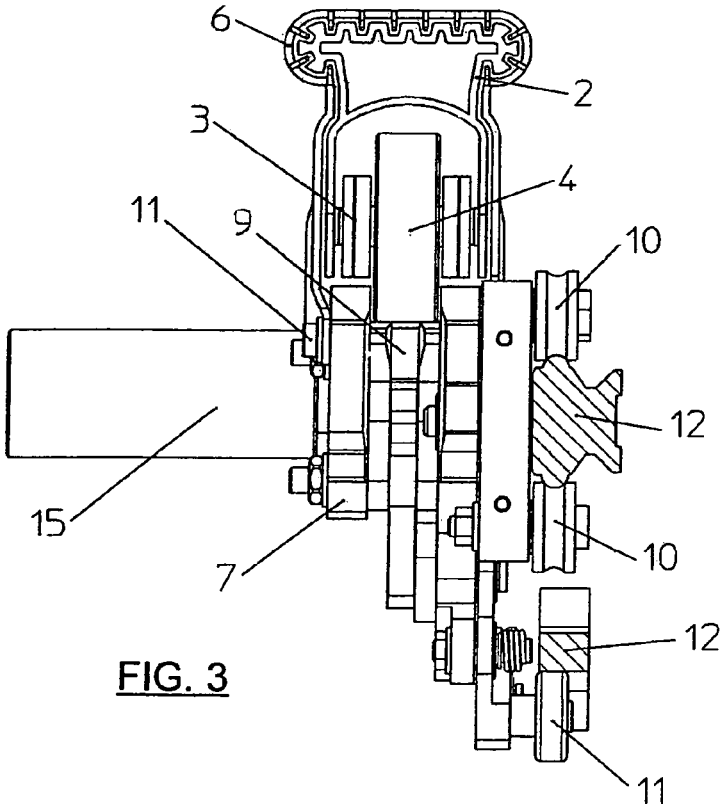
FIG. 3 shows a sectional view of the variable speed handrail according to section line III—III of FIG. 2.

The blocks 2 of the flexible profile 1 have a longitudinally grooved outer surface. For their part, the handgrips 6 have an inner ribbed surface, couplable to the grooved profile of the blocks 2, as can best be seen in FIG. 3.

The handgrips 6 and blocks 2 are mutually coupled with a certain clearance therebetween.

Figure 4:
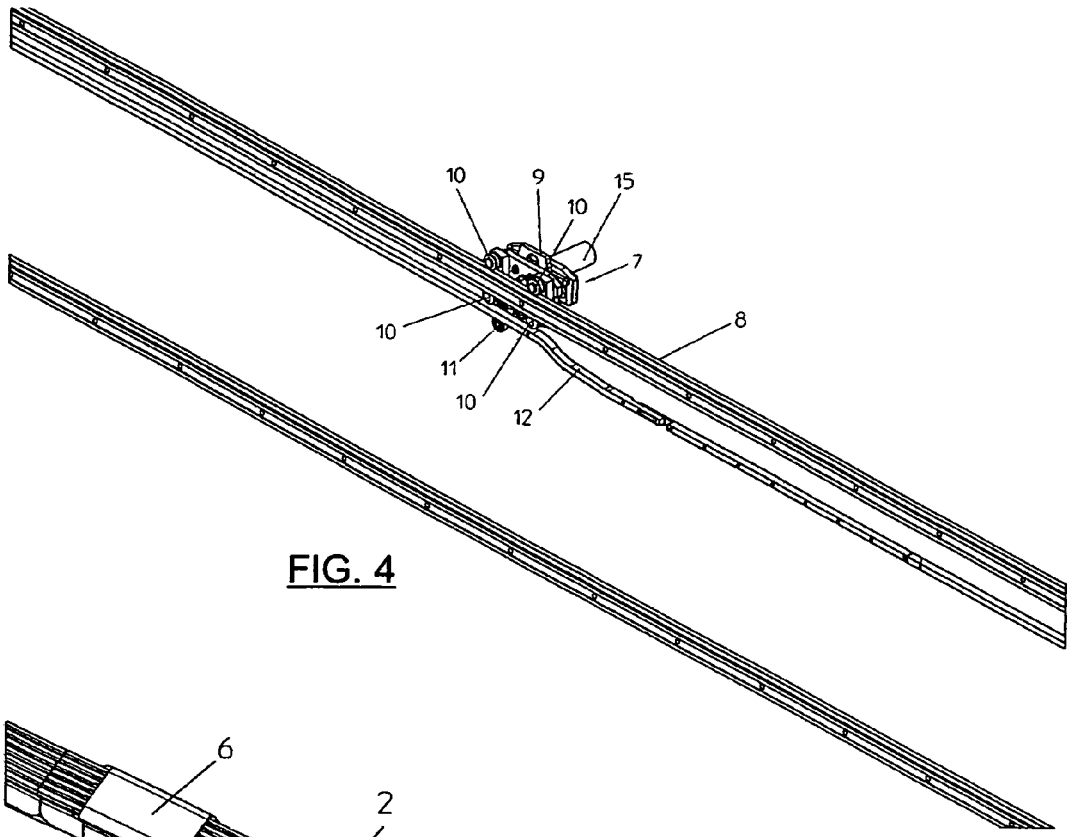
FIG. 4 shows a perspective view of the variable speed handrail guide system.

As can best be seen in FIG. 4, the carriages 7 are assembled on a guide 8 along which they can slide. These carriages carry an anchor tooth 9 which can shift between two limit positions, an upper interlocking position, shown in FIG. 9, in which said tooth is anchored between two consecutive rollers 4 of the chain 3, and a lower limit position, shown in FIG. 8, in which the tooth 9 is located under the rollers 4.

The carriage 7 slides on the guide 8 by means of four support rollers 10, two top rollers and two bottom rollers. The carriage 7 further includes a freely rotating wheel or roller 11 resting against a cam profile 12 of the guide 8 and is what causes the shifting of the anchor tooth 9 between the upper and lower limit positions already described.

Figure 9:
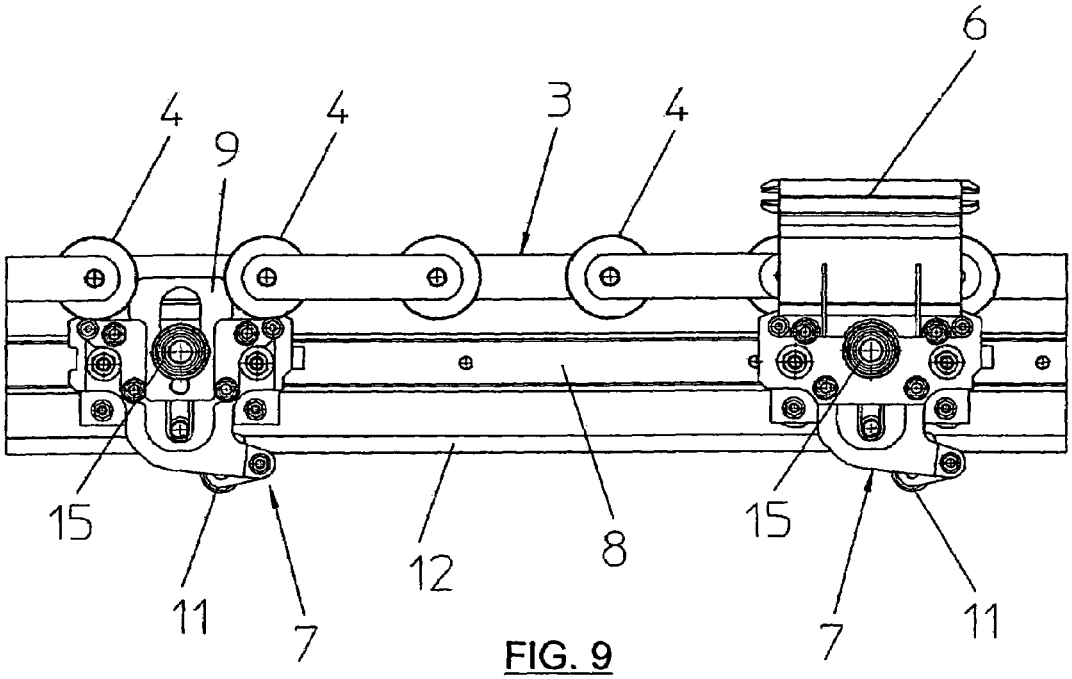
FIG. 9 shows a view similar to FIG. 8, corresponding to the constant speed area.

When the handgrips 6 shift along the section of the walkway or escalator in which the walkway plates thereof move at a constant speed, the roller 11 of the carriage 7 shifts on the cam guide 12 along the profile in which it shifts the anchor tooth 9 towards the upper limit position, as can be seen in FIG. 9, whereby the handgrips 6 are dragged by the chain 3 forming part of the flexible profile of the handrail. Therefore in these sections the handgrips 6 and blocks 2 of the flexible profile 1 shift at the same speed.

Figure 8:
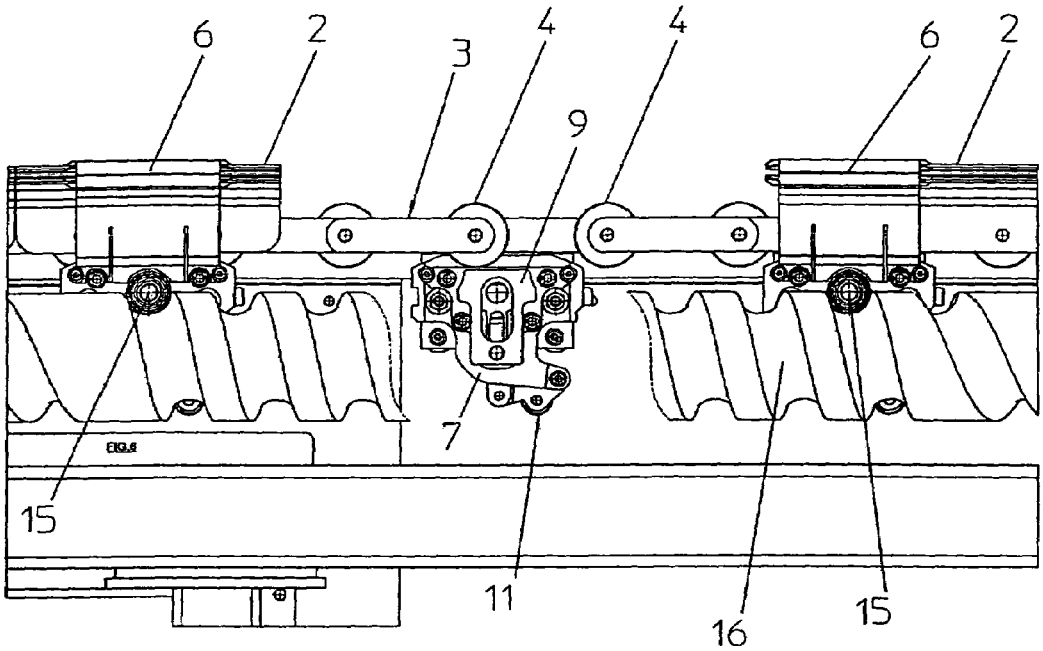
FIG. 8 shows a partial side view of the variable speed area, according to direction A of FIG. 6.

When the handgrips 6 shift along the section in which the walkway plates of the walkway or escalator move at a variable speed, the anchor tooth 9 takes the position of FIG. 8 due to the action of the cam profile 12. In this moment, the connection means of the handgrips 6 connected to a variable speed auxiliary drag mechanism begin operating.

Said means comprise an arm 15 laterally projecting from the carriages 7 and capable of meshing with a worm 16 running along the section in which the walkway plates move at a variable speed and make up the variable speed auxiliary drag mechanism.

Figure 5:
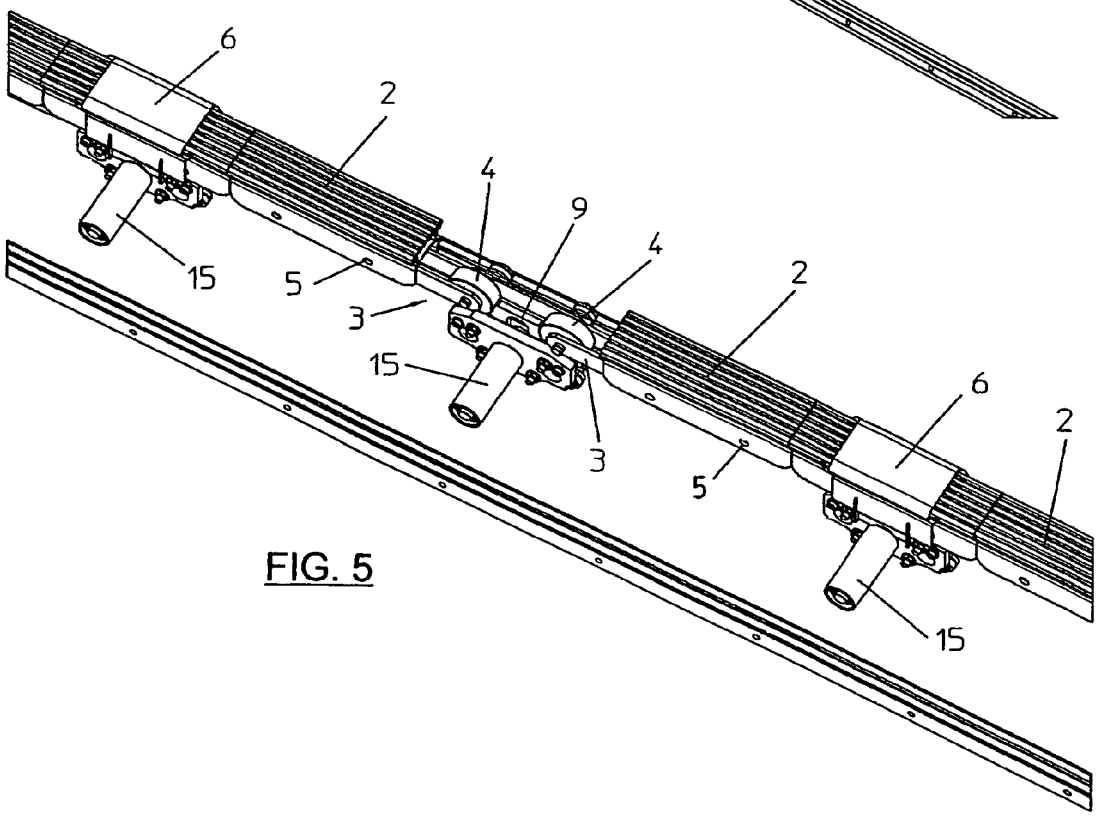
FIG. 5 shows a perspective view of the high speed area.

FIG. 5 shows the situation of the handgrips 6 in the high speed area, in the overturns and in the return of the handrail. The handgrips 6 are meshed with the chain 3 by means of the anchor tooth 9 introduced between two consecutive rollers 4 of the chain. As explained, this anchor tooth can mesh or de-mesh as it can be shifted according to the path followed by the roller 11 on the guide profile 12.

Figure 6:
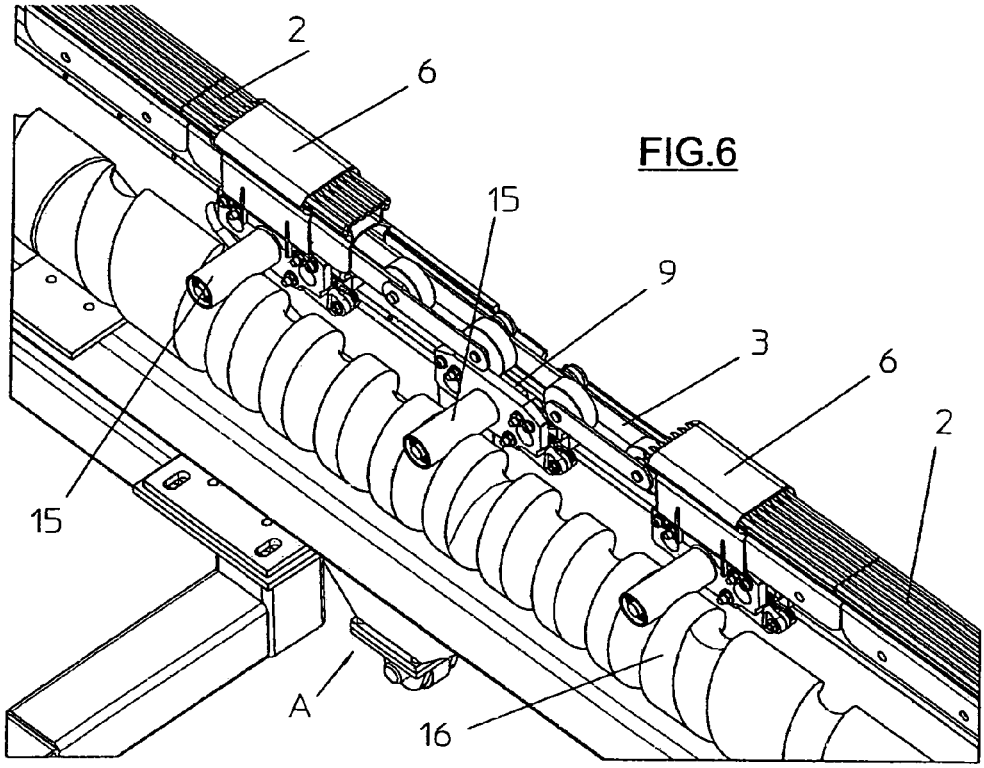
FIG. 6 shows a perspective view of the variable speed area.

FIG. 6 shows the situation of the handgrips 6 in the variable speed area. The handgrips mesh with the worm 16 by means of the arms 15, and in this area the anchor tooth 9 is in its withdrawn position.

The operation of the handrail of the invention is as follows. A motor 17, FIG. 1, acts on the chain 3 which moves at a constant speed. This speed is identical to the maximum speed of the walkway or escalator. The chain 3 furthermore transmits motion to the variable pitch worm 16 by means of a rigid transmission system 18. The drive ratio must be suitable so as to maintain a perfect synchronization between the variable pitch worm 16 and the chain 3. The handgrips 6 are driven by the chain 3 in the high speed and overturn areas. After exiting these areas, the handgrips 6 reach the variable speed area. In this moment, the anchor tooth 8 moved by the roller 11 of the carriage 7, FIG. 4, begins to de-mesh until reaching its limit withdrawal position in which it allows the chain 3 to circulate on the handgrips 1. On the other hand, the transverse arm 15 meshes with the variable pitch worm 16. The varying speed caused by the worm is as follows. The handgrips 6 are slowed down until reaching the minimum moving walkway or escalator operating speed. They are maintained at a low speed for a given time so as to allow users to get on, and they subsequently accelerate smoothly until reaching the maximum walkway or escalator speed, coinciding with the speed of the chain 3. All this is a result of the variable pitch of the worm 16. In this instant, the transverse arm 15 leaves the worm 16 and the anchor tooth 9 begins the upward movement until reaching its raised position between two consecutive rollers 4 of the chain 3. From this instant, in the high speed area the handgrips are dragged by the chain 3 until reaching the variable speed exit area. In this area, the reverse process as that previously described for the variable speed entrance area occurs. The handgrips 6 are de-meshed from the chain 3 and are moved by the variable pitch worm 16, which smoothly slows them down until reaching the minimum operating speed at which the passengers exit. Subsequently the handgrips 6 are again accelerated up to the maximum operating speed, and there transfer to the constant speed chain 3, which is responsible for conveying them in the overturns and in the handrail return, in order to begin the cycle again.

Figure 7:
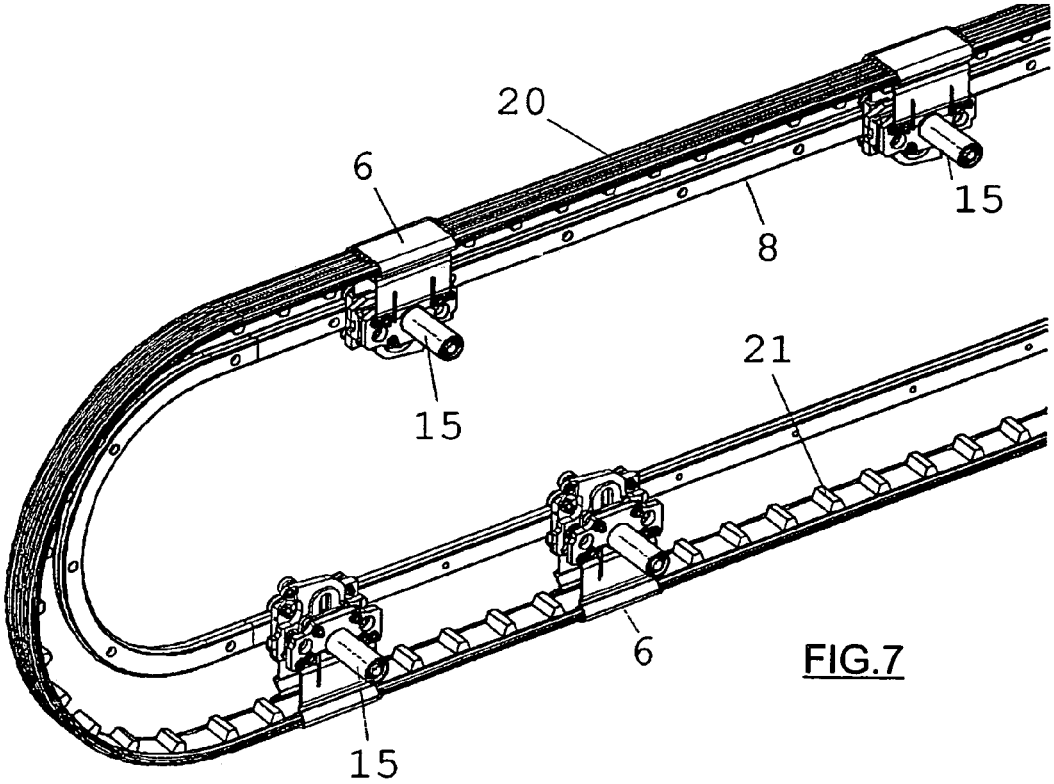
FIG. 7 shows a perspective view of the high speed area with a single flexible member.

The flexible profile 1 could be made up of a single flexible member 20, FIG. 7, with inner teeth 21 which would allow its drive by means of a toothed wheel.

As can be understood, other variable speed drive systems could be used, such as variable pitch chains or electromagnetic induction systems. In the same manner, it would also be possible to use other constructive forms for the continuous belt drive system, such as a friction or an electromagnetic induction system.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A variable speed handrail for a passenger moving walkway system or escalator, comprising:

a flexible profile, which circulates along the walkway or escalator, the profile including a forward moving section and a return section; the flexible profile moves at a constant speed;

a drag mechanism for the profile;

a plurality of handgrips coupled on the flexible profile, the handgrips are movable along the direction of the profile selectively with the profile or independent of the profile, the handgrips being movable at a speed substantially identical to a speed of walkway plates of the walkway system or escalator, which plates are the plates then closest to respective ones of the handgrips;

the handgrips having a first connection device connectable to a constant speed drag mechanism and a second connection device connectable to a variable speed auxiliary drag mechanism, both connection devices being operable for dragging the handgrips; the first connection device connects the handgrips to the constant speed drag mechanism when the handgrips are moved along a first section of the profile along which the walkway plates move at a constant speed, and the second connection device connects the handgrip to the variable speed auxiliary drag mechanism when the handgrips are moved along a second section of the profile along which the walkway plates move at a variable speed.

2. A handrail according to claim 1, wherein the constant speed drag mechanism is comprised of the flexible profile or of the drag mechanism of the profile.

3. A handrail according to claim 1, wherein the first connection device comprises an anchor tooth that is shiftable between an active position, wherein the tooth meshes with the flexible profile or with the drag mechanism for causing the dragging of the handgrip at the same speed as the flexible profile, and a withdrawn position wherein the tooth does not mesh with the flexible profile.

4. A handrail according to claim 1, wherein the second connection device comprises:

an arm projecting from one side of the handgrips; and a variable pitch rotatable worm positioned to extend along the second section of the profile along which the walkway plates move at a variable speeds, wherein the arm meshes with the worm so that rotation of the worm moves the arm and the attached handgrip along the profile.

5. A handrail according to claim 3, further comprising a guide inside the flexible profile;

a carriage on which each of the handgrips and the respective first and second connection devices are assembled and the carriage that can shift on the guide running inside the flexible profile and close to the drag mechanism of the flexible profile;

the guide being shaped and adapted to maintain a clearance or gap between the flexible profile and the handgrips;

a cam on the guide, the cam being shaped and operable for shifting the anchor tooth of each handgrip between the active and withdrawn positions thereof as the handgrip passes between the profile sections in which the walkway plates move at a variable speed and at a constant speed.

6. A handrail according to claim 1, further comprising a guide inside the flexible profile;

a carriage on which each of the handgrips and the respective first and second connection devices are assembled and the carriage that can shift on the guide running inside the flexible profile and close to the drag mechanism of the flexible profile;

the guide being shaped and adapted to maintain a clearance or gap between the flexible profile and the handgrips;

a cam on the guide, the guide being shaped and operable for moving the first connection device of each handgrip between the active and withdrawn positions as the handgrip passes between the profile sections in which the walkway plates move at a variable speed and at a constant speed.

7. A handrail according to claim 1, further comprising a drive mechanism for dragging the flexible profile at a constant speed and for driving the variable speed auxiliary mechanism.

8. A handrail according to claim 1, wherein the flexible profile includes a chain that is movable at a constant speed with the profile;

discrete members having a grooved structure and assembled on the chain, and the members cover the chain and allow users to hold on a serviceable area of the discrete members.

9. A handrail according to claim 1, wherein the flexible profile comprises an endless belt of resilient material, comprised of one or of several layers of different materials, and wherein the belt allows the users to hold on along a serviceable area of the profile.

10. A handrail according to claim 9, wherein the flexible belt has an inner toothed surface allowing the meshing of the belt with a constant speed drag mechanism.

11. A handrail according to claim 8, wherein the discrete members have a grooved geometry forming part of the flexible profile and have a longitudinally grooved visible surface so as to facilitate the transition of a user's hand to the handgrips circulating on the flexible profile.

12. A handrail according to claim 1, wherein the handgrips have a respective profile fitted to a profile of the flexible profile and the handgrips are movable on and with respect to the profile when the handgrips move at a variable speed.

13. A handrail according to claim 1, wherein the handgrips internally have a system of ribs or ridges coupled between grooves of the flexible profile for facilitating the transition of a user's hand between the profile and the handgrips.

14. A handrail comprising:

a flexible profile, drive elements for guiding the profile to move at a first speed along a movement path;

a plurality of independently movable handgrips supportable on the profile to be movable by and along the moving profile;

a shiftable connecting element at each of the handgrips and shiftable between a first condition at which the connecting element connects the respective handgrip to the profile for the handgrip to move with the profile and a second condition where the handgrip at the profile is disconnected from the profile such that the handgrip may then be moved relative to the profile;

shift devices at locations along the profile operable on each of the connecting elements as it is moved past the shifting devices to move the connecting elements between the first and second conditions;

a second handgrip drive positioned along part of the length of a movement path of the profile at a location along the profile where each of the connecting elements is in the second condition, and the second handgrip drive is engageable there with the handgrips so that the handgrips then in engagement with the second drive are driven by the second drive and are driven to move with respect to movement of the profile.

15. The handrail according to claim 14, wherein the second handgrip drive is operable to move the handgrips in the movement direction of the profile but at a different speed.

16. The handrail according to claim 15, wherein the second drive is operable to move the handgrips slower than the profile in the movement direction.

17. The handrail according to claim 14, wherein the second drive comprises a worm rotatable on an axis generally along the direction of the profile movement with a connection to the handgrips passing along the worm to control the movement speed of the handgrips then passing the worm.

* * * * *